US005819334A

United States Patent [19]

Maze

[11] Patent Number: 5,819,334

[45] Date of Patent: Oct. 13, 1998

[54] TEXTURED BEDPAN

[75] Inventor: Jack Maze, Mundelein, Ill.

[73] Assignee: Medline Industries, Inc., Mundelein, Ill.

[21] Appl. No.: 132,529

[22] Filed: Oct. 6, 1993

Related U.S. Application Data

[63] Continuation-in-part of Ser. No. 82,600, Jun. 25, 1993, abandoned.

[51] Int. Cl.[6] ..... A61G 9/00

[52] U.S. Cl. ..... 4/450; 4/457

[58] Field of Search ..... 4/450, 451, 452, 4/453, 454, 455, 456, 457, 582, 583, 237; 297/452.42, 452.43, 452.45, 195.1, 215.16, 452.12, 452.14

[56] References Cited

U.S. PATENT DOCUMENTS

| | | | |
|---|---|---|---|
| 2,195,156 | 3/1940 | Steward | 4/455 |
| 2,304,631 | 12/1942 | Ensing | 4/450 |
| 2,481,427 | 9/1949 | Hunter | 4/245.3 |
| 3,212,107 | 10/1965 | Meletiou | 4/450 |
| 3,453,664 | 7/1969 | Gilbert | 4/455 |
| 3,597,771 | 8/1971 | Rickmeier, Jr. | 4/450 |
| 3,740,096 | 6/1973 | Bridger | 297/452.43 |
| 3,763,502 | 10/1973 | Laumann | 4/452 |
| 3,999,224 | 12/1976 | Kollsman | 4/583 |
| 4,368,548 | 1/1983 | Glass | 4/450 |
| 4,457,029 | 7/1984 | Matthews | 4/237 |

FOREIGN PATENT DOCUMENTS

| | | | |
|---|---|---|---|
| 2746688 | 4/1979 | Germany | 4/237 |

*Primary Examiner*—Charles R. Eloshway
*Attorney, Agent, or Firm*—Laff, Whitesel, Conte & Saret, Ltd.

[57] ABSTRACT

An all plastic bedpan has a seat with textured upper surface which prevents the formation of surface tension and provides air passageways at the interface between the patient and the textured seat surface.

13 Claims, 4 Drawing Sheets

TEXTURED BEDPAN

This is a continuation-in-part application of Ser. No. 08/082,600, filed Jun. 25, 1993 now abandoned.

This invention relates to bedpans and more particularly to all plastic bedpans with non-stick surfaces at the interface between a patient and the bedpan.

Bedpans are well-known devices which are used as portable toilets, especially for bedridden people. Most of these bedpans are now molded plastic devices which are made in such a low cost manner that they may be discarded after use. Heretofore, these plastic bedpans were simply copied from the earlier metal pans, which were made of enameled or stainless steel. All surfaces of those metal bedpans were very smooth and slick, almost like glazed pottery, since they were designed for a sanitary clean-up.

When plastic was used to make the bedpans, the same highly polished, smooth and slick surfaces were used. In part, this was merely an adoption of existing designs. Also, among other reasons, the smooth plastic surface occurred because the surface of the mold is highly polished to a mirror like finish. This use of polished plastic surfaces led to two problems. First, plastic is lightweight and flexible so that the weight of a body resting on the bedpan tended to spread it and a removal of the weight tended to relax the spread thus causing the bedpan to more or less grip the patient. Second, the slick polished, plastic surface tended to stick to the skin of the patient owing to his perspiration, weight, moisture, body oils, and the like. Another consideration is that a bedridden patient may not be very agile and may have impaired body motion. Even under ideal conditions, such a patient might find it difficult to move freely.

Therefore, the combination of these problems and events sometimes tended to make it very difficult to use the bedpans. Sometimes the bedpan literally stuck to patients, to an extent that they could not help themselves and had to call for help. Sometimes there was a spillage which defeated the disposable bedpan concept.

Accordingly, an object of the invention is to provide new and improved bedpans which overcome the above described problems. Here, an object is to provide a bedpan which has such a low cost that it might be discarded after a single use. In particular, an object is to provide a bedpan which cannot stick to a patient.

In keeping with an aspect of the invention, these and other objects are accomplished by a molded all plastic bedpan having a textured surface in all areas which normally confront the patients skin. The graphical design of the texture is unimportant; however, the depressions of the texture should be in communication with each other and be deep enough to form passageways for air to escape. Conversely, stated the depression must not be a closed surface to the extent that they might in effect form vacuum cups when the patient's skin is pressed against and into them. On the other hand, the peaks of the texture should not be so extreme or pointed that they form points of discomfort or skin abrasion. Ideally, the textured surface would be smooth enough overall so that the patient's perception is the same as it is when the surface is highly polished.

A preferred embodiment of the invention is shown in the attached drawings, wherein.

Figure 1:
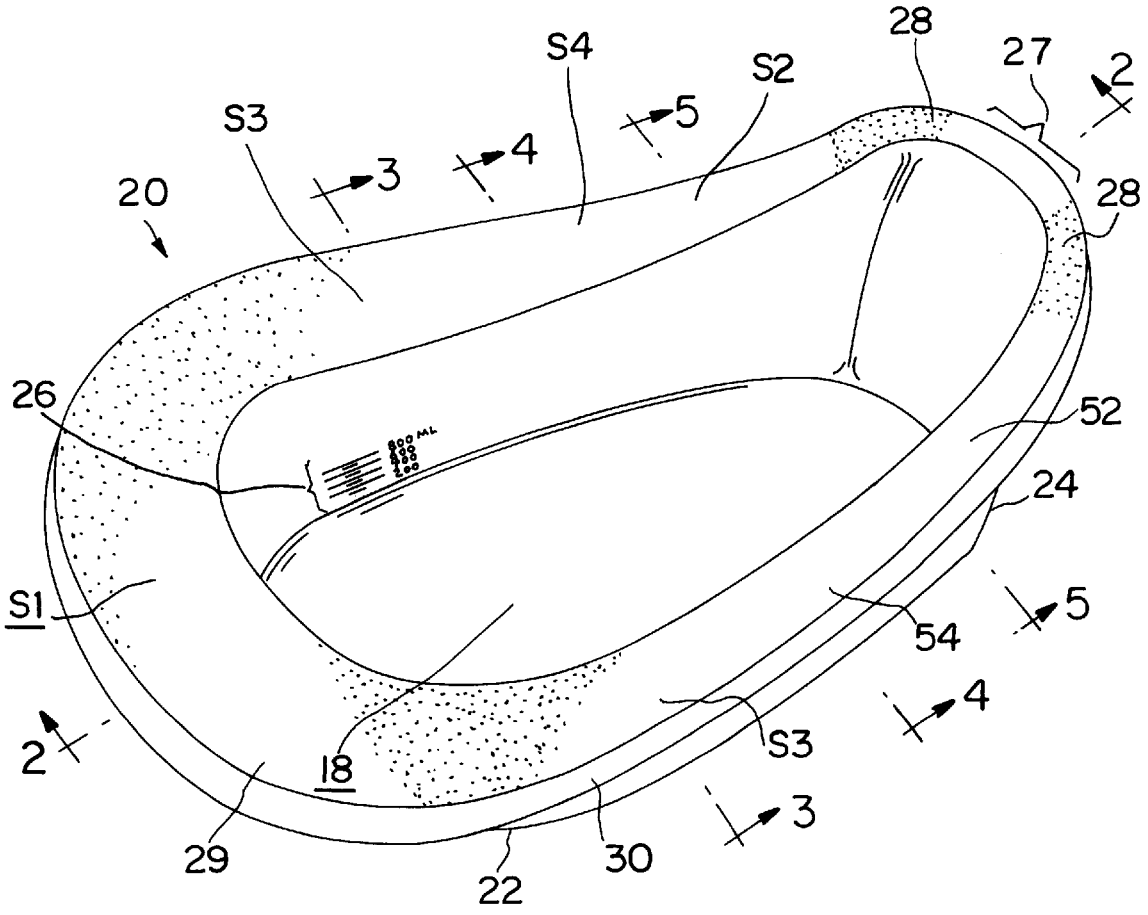
FIG. 1 is a perspective view of the inventive bedpan having a seat forming flange extending outwardly from the bowl thereof.
Figure 2:
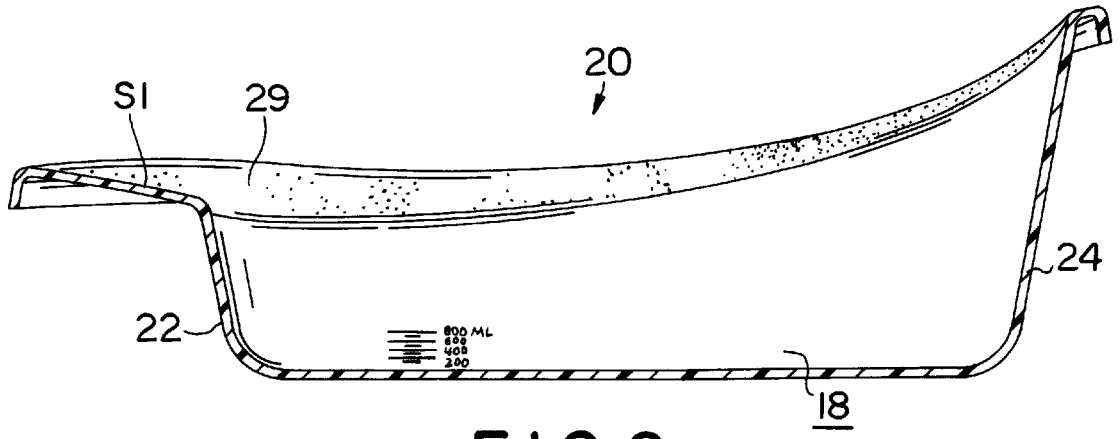
FIG. 2 is a longitudinal cross sectional view taken along line 2—2 of FIG. 1.
Figure 3:
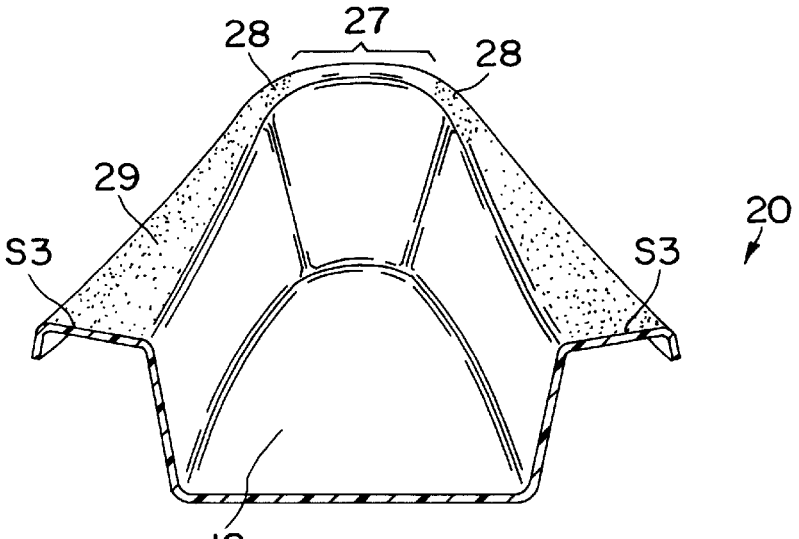
FIG. 3 is a transverse cross sectional view taken along line 3—3 of FIG. 1.

A one piece molded plastic bed pan (FIG. 1) has a bowl 18 of a generally conventional shape, which is more or less dictated by the anatomical details of the human body. In general, bowl 18 is lower in the back 22 and higher in the front 24. A volume scale 26 may be molded into a side wall of the bedpan. The bowl 18 terminates at its upper edge with a strengthening member in the form of an outwardly extending flange forming a seat with a somewhat modified oval opening and a brim. At the front of the opening, there is a fairly flat section 27 defined by two corners 28, 28, leading to the elongated sides of the oval.

The upper surface of the seat 29 gradually changes from a generally rounded upper surface, S1 in the back at to a relatively steep upper drainage surface S2 near the front 24. A vertical dependent perimeter wall 30 surrounds the outer edge of the seat to give it added weight supporting strength.

Figure 4:
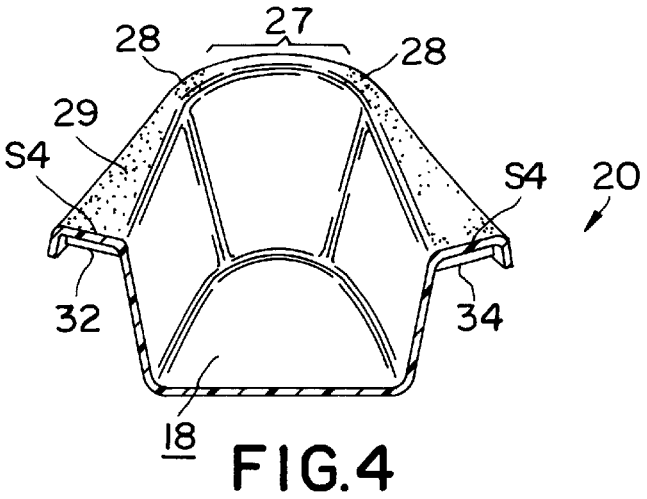
FIG. 4 is a transverse cross sectional view taken along line 4—4 of FIG. 1.
Figure 5:
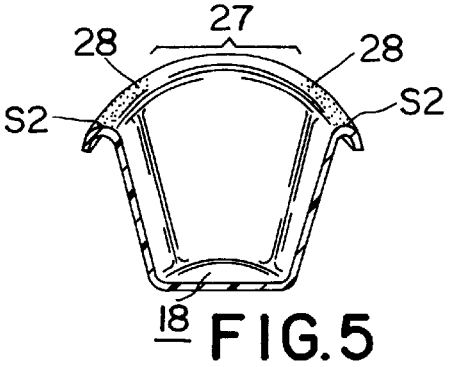
FIG. 5 is a transverse cross sectional view taken along line 5—5 of FIG. 1.

As shown in FIG. 4, fins 32, 34 may extend from the vertical wall of bowl 18 to the perimeter wall 30 in order to strengthen and stabilize it. While any suitable number of such fins may be provided wherever needed, at least one fin should be located on each side of the bowl 18 at a point where the patient's legs would exert a maximum weight.

The surface (FIG. 6) of the seat 29 is textured at 40 by being made in a mold with an engraved surface 40 in the seat forming area. The engraved surface of the mold may be created by either chemical etching or mechanical means. Chemical etching is preferred, especially since the etched depressions automatically tend to communicate with each other and provide air passageways through the depressions.

The preferred texture is one with depressions D which are in the range of about 0.002–0.005 inches deep (as shown at 42) with draft angles 44 for the side walls of the depressions in the range of at least 2°–5°. The draft angles make it easier to open a mold after the plastic has cooled. In one embodiment which was built and tested the depressions were an average 0.003 inches deep and the draft angle was at least 4.5°.

The entire surface of the seat should preferably be textured. However, in the area 27, the width of the mold becomes relatively small so that the etching process becomes difficult. Accordingly, the surface at 27 may remain the smooth surface which results from a polished surface in the mold. Nevertheless, the texture should continue into the area 28, 28 which tends to become the front some what rounded "corners" of the seat.

There are two principles which are invoked by the textured surface. The first principle is that surface tension does not form at the interface between the plastic seat and the skin. The second principle is that air passageways allow air to escape when the bedpan is being installed prior to use and thus results in an airflow which prevents the plastic and skin surfaces from clinging to each other.

Figure 7:
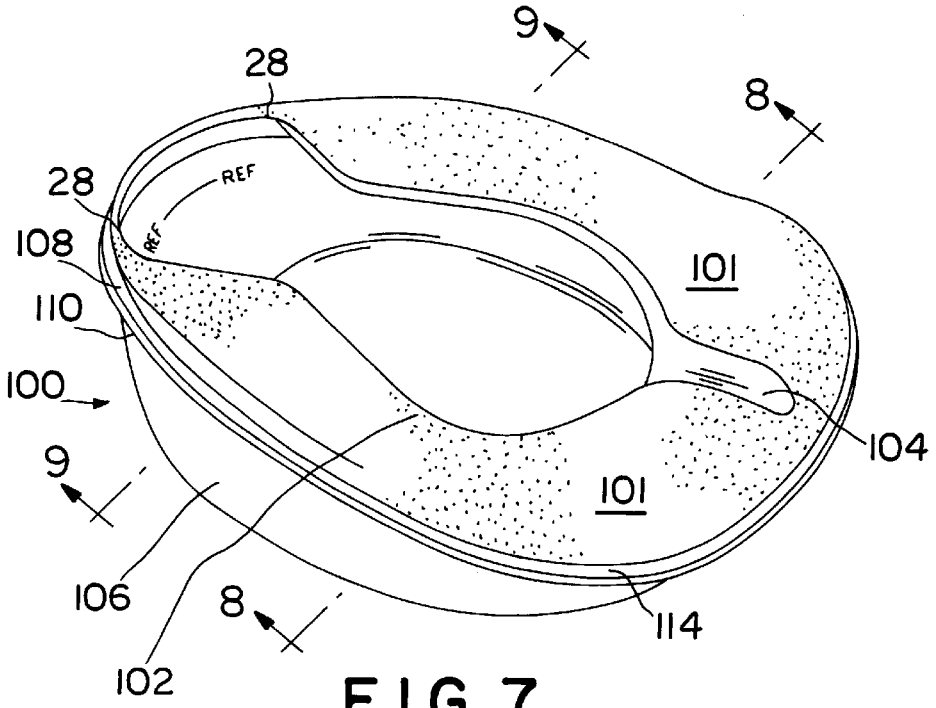
FIG. 7 is a perspective view of a second embodiment of a bed pan having a seat forming flange which extends inwardly.
Figure 8:
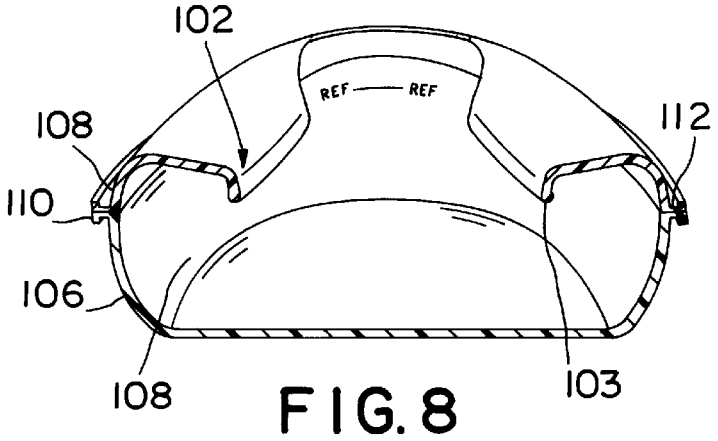
FIG. 8 is a cross section taken at line 8—8 of FIG. 7.
Figure 9:
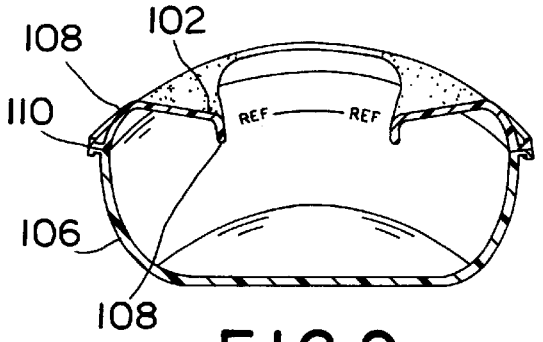
FIG. 9 is a cross section taken at line 9—9 of FIG. 7.

FIGS. 7–9 show a second embodiment of the invention wherein the bed pan 100 is generally bowl shaped, having a seat portion 101 formed by an inwardly directed peripheral flange 102 that leads from a upper edge of the bowl and tends to partially cover the bowl. An edge rib 103 is a strengthening member which reinforces the flange and adds to its load carrying capacity. A drainage member 104 is a trough formed in the flange member to drain back into the interior of the bowl.

The bowl is made from two pieces 106, 108 which are heat sealed around the perimeter, as at 110. The heat seal is made in such a manner that a gutter-like depression 112 surrounds the bowl. As best seen in FIG. 8, the flange 102 has a generally broad, curved surface in the area of section line 8—8 and a relatively steep drainage surface in the area of section line 9—9.

The upper surface 114 of the flange 102 is textured in the area which comes into contact with the patient's skin.

Figure 10:
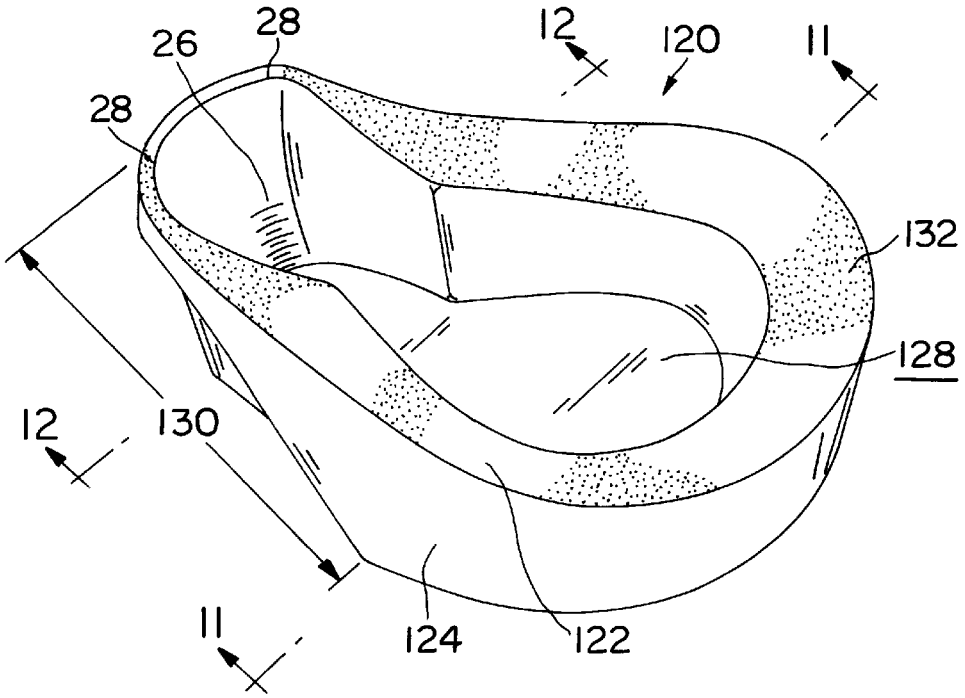
FIG. 10 is a perspective view of a third embodiment of a bed pan having a flange which extends from an upper edge of the bowl outwardly to a strengthening wall surrounding the bowl.
Figure 11:
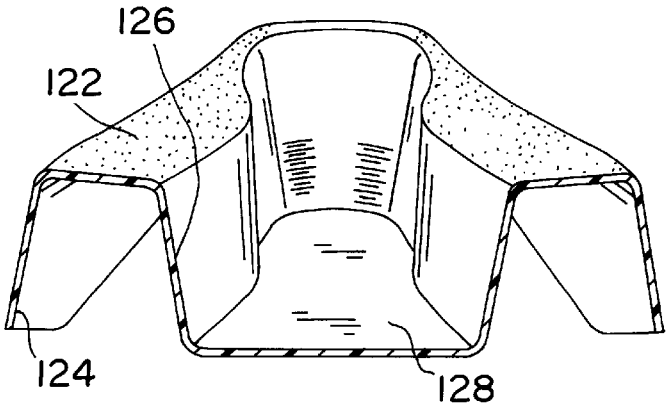
FIG. 11 is a cross section taken along line 11—11 of FIG. 10.
Figure 12:
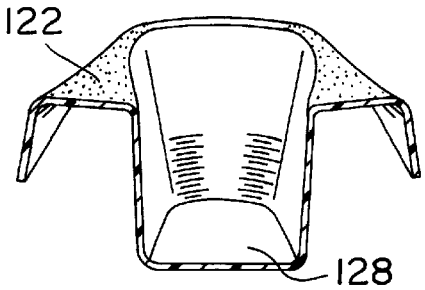
FIG. 12 is a cross section taken along line 12—12 of FIG. 10.

A third embodiment 120 of a bed pan is seen in FIGS. 10–12. Here, the seat forming flange 122 leads outwardly from an upper edge of the bowl to a strengthening outside wall 124 which in effect doubles the weight carrying ability of the side wall 126 of the bowl 128. The outside wall 124 almost completely surrounds the bowl 128. However, it slopes upwardly in the front area 130 of the bowl to provide a convenient place to hold when picking up the bed pan.

Again, the flange 122 is relatively broad in the area of section lines 11—11, and steep for drainage in the area of section line 12—12.

Figure 6:
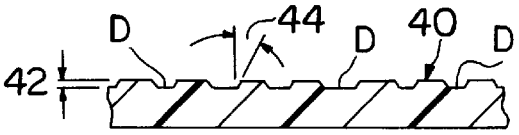
FIG. 6 shows a fragmentary part of a cross section of the textured plastic on the seat of the bedpan.

In both of the embodiments of FIGS. 7–9 and 10–12 the upper surfaces of the seat forming flanges are textured in the area which comes into contact with the patient's skin. The texture is the same on all embodiments, as shown in FIG. 6 and described above. The depressions of the texture are in communication with each other and are deep enough to allow air to escape at the interface between the patient's skin and the plastic surface of the bed pan.

Those who are skilled in the art will readily perceive how to modify the invention. Therefore, the appended claims are to be construed to cover all equivalent structures which fall within the true scope and spirit of the invention.

The claimed invention is:

1. A disposable molded all plastic sanitary bed pan comprising a bowl having a seat at an upper edge of said bowl, and a texture formed on a surface of that portion of said seat which comes into contact with the skin of a patient, said texture having interconnected depressions forming communicating passageways for allowing an escape of air through said interconnected depressions at an interface between patient and seat, whereby said bed pan is much less likely to cling and stick to said patient.

2. An all plastic, molded bedpan having a bowl with a modified oval horizontal cross section, said bowl being higher in a front than in a back, a flange extending from an upper edge of said bowl to form a seat on said bowl , said flange having a generally rounded upper surface at the back of said bowl, said rounded upper surface gradually changing to a steeper drainage surface at the front of said bowl, and a strengthening member at an unattached peripheral edge of said flange, said upper surface of said flange having a texture with mutually interconnected depressions which prevent surface tension and which provide air passageways at an interface between a patient and said flange so that air may move through said interconnected depressions in said texture in order to prevent said bed pan from sticking to said patient.

3. The bedpan of claim 1 or 2 wherein an average of said depressions is in the range of about 0.002–0.005 of an inch deep.

4. The bedpan of claim 3 wherein side walls of said depression have a draft angle in the order of at least 2°–5°.

5. The bedpan of claim 1 or 2 wherein on average said depressions are about 0.003 of an inch deep.

6. The bedpan of claim 4 wherein side walls of said depression have a draft angle in the order of at least 2°–5°.

7. The bedpan of claim 1 or 2 wherein the side walls of said depression have a draft angle in the order of at least 2°–5°.

8. The bedpan of one of the claims 1 or 2 wherein side walls of said depression have a draft angle of at least substantially 4.5°.

9. The bedpan of one of the claims 1 or 2 wherein said seat having a modified oval opening formed therein,said modified oval has two areas in front which tend to form corners between long sides and a front side of said oval, and said texture continues at least into said front corners.

10. The bed pan of claim 1 wherein said seat is a flange which is outwardly directed from an upper edge of said bowl.

11. The bed pan of one of the claims 1 or 2 wherein said seat is a flange extending outwardly from said bowl.

12. The bed pan of one of the claims 1 or 2 wherein said seat is a flange extending from an upper edge of the bowl outwardly to a strengthening outside wall surrounding said bowl.

13. The bed pan of claim 2 wherein said flange is outwardly directed from an upper edge of said bowl.

* * * * *